United States Patent [19]

Kienzle

[11] 4,250,499

[45] Feb. 10, 1981

[54] SOUND LEVEL DETECTOR WITH PROGRAM INTERRUPT

[76] Inventor: John A. Kienzle, 1802 N. Broadway, Shawnee, Okla. 74801

[21] Appl. No.: 47,014

[22] Filed: Jun. 11, 1979

[51] Int. Cl.[3] ..... G08B 13/22

[52] U.S. Cl. ..... 340/566; 307/117; 340/540

[58] Field of Search ..... 340/566, 692, 531, 540, 340/34; 325/466, 364; 307/117; 455/344

[56] References Cited

U.S. PATENT DOCUMENTS

| | | | |
|---|---|---|---|
| 3,014,199 | 12/1961 | Dill et al. | 340/34 |
| 3,471,846 | 10/1969 | Cotter et al. | 340/566 |
| 3,701,024 | 10/1972 | Knowles et al. | 325/364 |
| 3,719,891 | 3/1973 | Lee | 340/566 |
| 3,873,963 | 3/1975 | Neal et al. | 340/34 |
| 3,876,940 | 4/1975 | Wickford et al. | 325/466 |
| 3,984,803 | 10/1976 | Hawk et al. | 340/566 |
| 4,091,366 | 5/1978 | Lavallee | 340/524 |

*Primary Examiner*—Glen R. Swann, III

*Attorney, Agent, or Firm*—Robert M. Hessin

[57] ABSTRACT

A sound receiver outputs a signal to a sound level detector and to a notification signal generator. The sound level detector outputs a signal to a first input of a switch, and the notification signal generator outputs a signal to a second input of the switch. Also input into the switch is the program from a program source. Under control of the sound level detector, the switch either outputs the program or the notification signal to an output element of the alarm system whereby the program is interrupted and the notification signal substituted therefor on detection of a sound level greater than a preselected level.

15 Claims, 4 Drawing Figures

SOUND LEVEL DETECTOR WITH PROGRAM INTERRUPT

BACKGROUND OF THE INVENTION

This invention relates generally to apparatus for detecting the presence of sound and more particularly, but not by way of limitation, to sound detecting apparatus which interrupt a program to which a person is listening for the purpose of notifying such person of the detected sound.

The following statement is intended to be a prior art statement in compliance with the guidance and requirements of 37 C.F.R. Sers. 1.56, 1.97 and 1.98.

U.S. Pat. No. 3,471,846 issued to Cotter et al proposes a sound responsive intruder detection circuit which utilizes two channels, a main channel and a cancel channel, to detect the presence of sound. The two channels are to be used to differentiate between "friendly" and "unfriendly" sounds. When an unfriendly sound is detected, the proposed device is to activate an alarm relay.

U.S. Pat. No. 3,984,803 issued to Hawk et al proposes a seismic intrusion detector system which is to include means for generating an electrical signal in response to seismic movement of the generating means, a bandpass amplifier coupled to the generating means, a threshold detector means for passing signals from the amplifier exceeding a preselected voltage level, means for counting and storing the signals, variable frequency oscillator means for generating and transmitting on demand an audio signal representing the number of man-associated seismic movements detected by the device, and means for monitoring the audio signal.

U.S. Pat. No. 4,091,366 issued to Lavallee discloses a sonic monitoring method and apparatus. The apparatus is proposed to include microphones for picking up sounds, discriminators for generating alarm signals when the power of the amplified input from the microphones exceeds a predetermined level, timers for generating predetermined timing signals responsive to the generation of the alarm signal, switches which are activated when an alarm signal is detected, and an audio output.

U.S. Pat. No. 3,719,891 issued to Lee proposes still another type of sound detection system.

From these references it is apparent there is a need for an alarm device which detects the presence of sound. However, there is also the need for such a device to have a relatively simple design and construction so that it may be more easily manufactured and maintained. Furthermore, there is the need for a device which can detect a sound and then interrupt a program which a person is perceiving so that the person can be notified of the sound. In this way, the person is made aware of sounds which are external to the perceived program and of which the person would otherwise be unaware.

Although each of these references proposes a type of sound detection and alarm device, it is believed that these references fail to disclose such a device having a relatively simple design which enhances the ease of manufacture and maintenance thereof. It is further believed that these cited references fail to propose a system for interrupting a program to which a person is listening when a sound is detected and for audibly presenting the detected sound to the listener during the interruption. In particular, it is believed that the cited references fail to propose an apparatus which interrupts a program to which a person is listening on a set of earphones and presents the detected sound to the listener through the earphones.

SUMMARY OF THE INVENTION

The present invention overcomes the above-noted and other shortcomings of the prior art by providing a novel, useful, non-obvious and improved sound detection alarm. In particular, this apparatus has a relatively simple design for enhancing the ease of manufacture and maintenance. Furthermore, this invention provides a device which detects sound, interrupts a program to which a person is listening when a sound in excess of a predetermined alarm level is detected, and outputs the detected alarm sound to the person. With the present invention, then, the person is notified of sounds he would otherwise be unaware of and thus can be alerted to any intruders or alarm conditions, for example.

More particularly, the apparatus for notifying a person of the presence of a detected sound includes means for detecting a sound, a source of a program which the person wishes to perceive, output means for communicating the program to this person, means associated with each of these three elements for switching the output means between the detecting means and the program source depending upon the presence or absence of a detected alarm sound, and means connected to the sound detecting means and to the switching means for controlling this switching of the output means between the sound detecting means and the program source. This apparatus may also include a means connected between the sound detecting means and the switching means for generating an output notification signal.

During operation of this apparatus, the detecting means responds to the presence of a sound. The controlling means monitors the detecting means for such a response and when a response which is in excess of a predetermined level is discerned, the controlling means provides an interrupt signal to the switching means thereby causing the switching means to disconnect the output means from the program source and then to connect the output means to the detecting means or to the notification signal generating means if the latter is used. By functioning in this manner the apparatus of the present invention notifies a person of the presence and nature of a detected sound.

Therefore, from the foregoing, it is a general object of the present invention to provide a novel, useful, non-obvious and improved sound detecting alarm apparatus. Other and further objects, features and advantages of the present invention will be readily apparent to those skilled in the art on a reading of the description of the preferred embodiment which follows, when taken in conjunction with the accompanying drawings.

DETAILED DESCRIPTION OF A PREFERRED EMBODIMENT OF THE INVENTION

Figure 1:
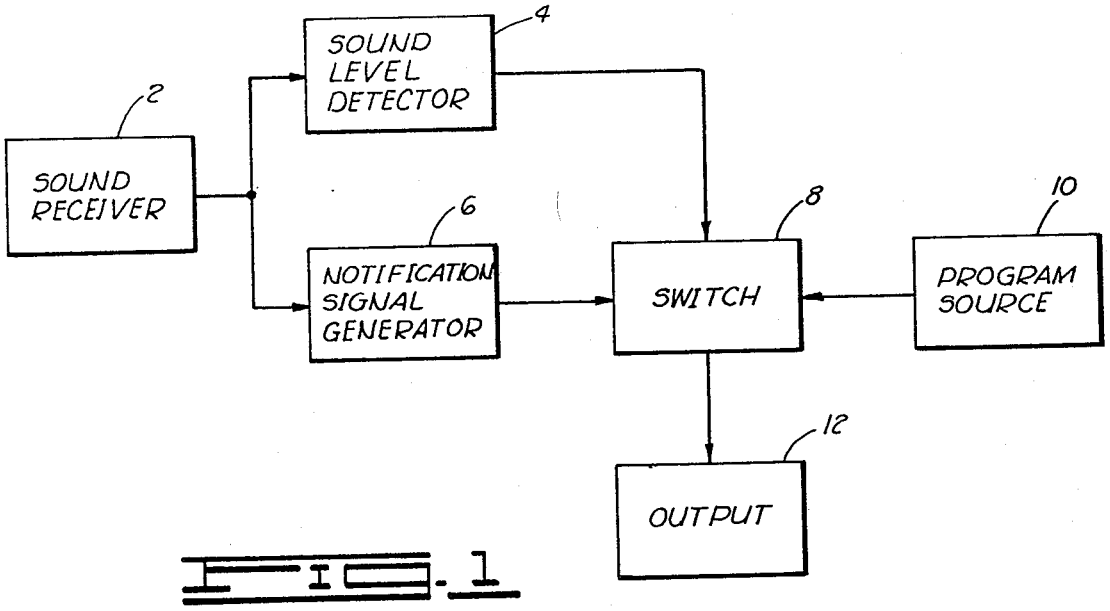
FIG. 1 is a functional block diagram of the present invention.

With reference now to the drawings and in particular to FIG. 1, there is shown a block diagram of a preferred embodiment of the functional elements of the present invention. The elements include a sound detecting means, or sound receiver 2, a sound detector 4, a notification signal generating means 6, a switch means 8, a program source 10, and an output means 12. The sound receiver 2 has an output which is connected to a controlling means indicated in FIG. 1 as the sound level detector 4. The sound receiver 2 output is also shown to be connected to the notification signal generating means 6. The sound level detector 4 has an output which is connected to a first input of the switching means 8. The switching means 8 includes a second input to which the output from the notification signal generator 6 is connected. The switch means 8 further includes a third input to which is connected the output from the source program 10. The program source 10 may be any type of means for providing a program of information or other matter perceivable by a person, such as a high-fidelity stereo sound system. Completing the FIG. 1 diagram is the outpt means 12 which is connected to the output from the switch means 8. The output means 12 could be, for example, a set of headphones or earphones to be used in conjunction with the hi-fi system, for example, used as the program source 10.

Figure 2:
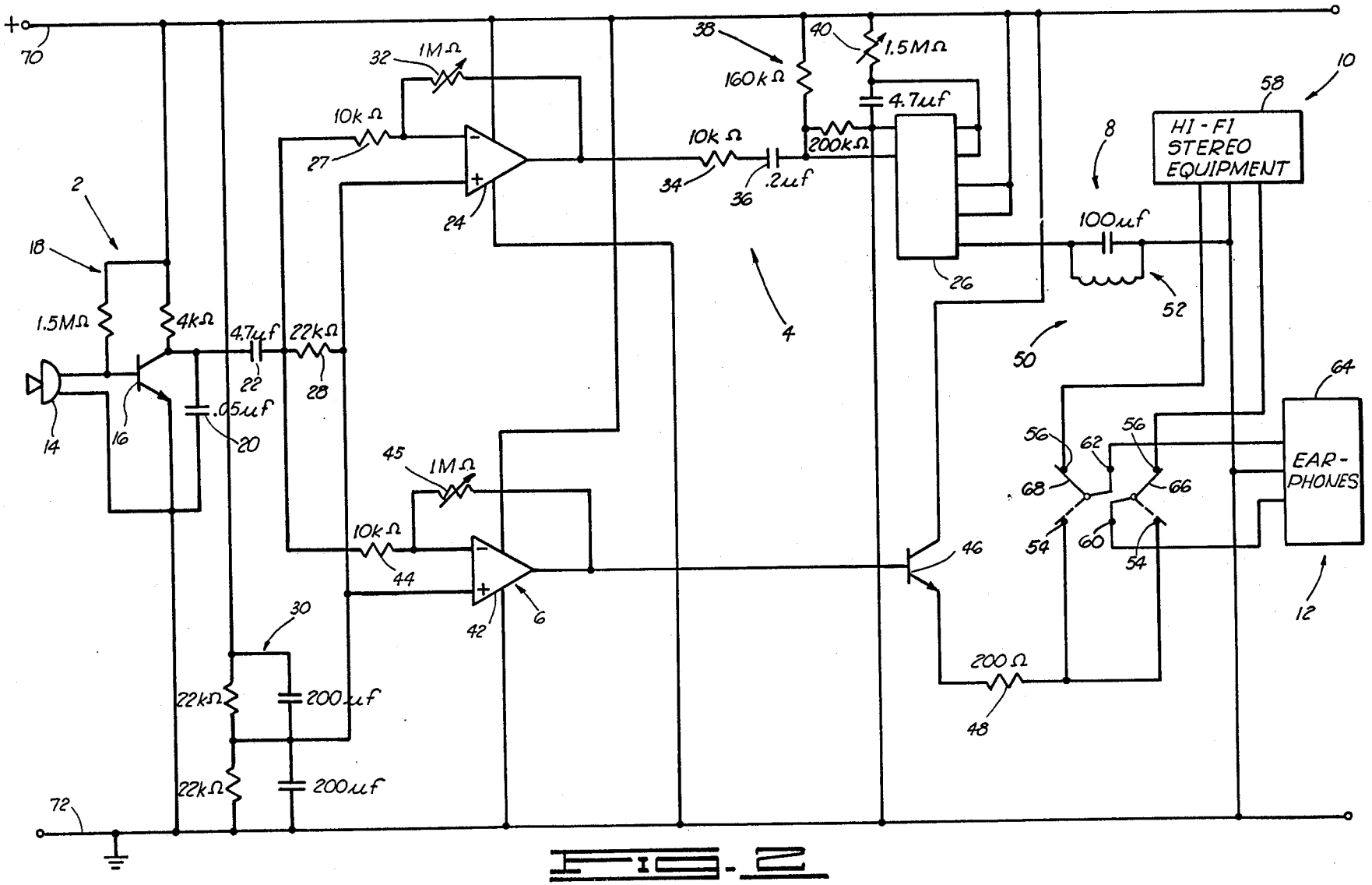
FIG. 2 is a schematic drawing of a preferred electrical circuit embodiment of the present invention.

With reference now to FIG. 2, a preferred electrical circuit embodiment of the previously mentioned functional elements will be described. The sound receiver 2 includes a sound transducer for receiving sound pressure waves and converting these pressure waves into electrical signals. In FIG. 2 this transducer is specifically identified as a microphone 14. Also included in the sound receiver 2 is a first transistor 16 functioning as a line receiver and amplifier of the electrical signals provided by the microphone 14. Connected between the collector and base of the transistor 16 is a resistor network 18 for biasing and other purposes as known by those skilled in the art. Connected between the collector and emitter of the transistor 16 is a first capacitor 20 for shunting the excessively high frequency components of the electrical signals to ground. Further connected to the transistor 16 is a second capacitor 22 for providing AC coupling between the output of the sound receiver 2 and the remainder of the circuit. In particular, this output is coupled to the sound level detector 4 and to the notification signal generator 6.

The preferred embodiment of the sound level detector 4 is shown to include a first operational amplifier 24 and a monostable multivibrator 26. The first operational amplifier 24 has an inverting input which receives through a first resistor 27 the output from the sound receiver 2. The first operational amplifier 24 also includes a non-inverting input which is connected to a network including a second resistor 28 connected between the second capacitor 22 and a first resistor-capacitor network 30 as shown in FIG. 2 and as known by those skilled in the art. The first operational amplifier 24 also includes a first variable resistor 32 connected between the inverting input and the output of the operational amplifier. The first variable resistor 32 provides a first gain adjustment control for variably setting a predetermined detection level. This predetermined detection level thus determines what magnitude of sound must be received and converted into an electrical signal before the sound detection alarm system of the present invention provides an alarm signal to the person using the device. Thus, this first operational amplifier 24 is a preferred embodiment of a means for determining when a detected sound magnitude exceeds a predetermined level. More particularly, it is a sensitivity set member for adjustably establishing a detection level for the received sounds below which no switching of the switch means 8 will occur.

The monostable multivibrator 26 is connected to the output from the first operational amplifier 24 through a third resistor 34 and a third capacitor 36. Also connected to the multivibrator 26 in a manner known to those skilled in the art is a second resistor-capacitor network 38 which includes a second variable resistor 40. The second variable resistor 40 provides an adjustable time constant means for variably setting a predetermined duration of a switching control signal generated by the multivibrator 26 for controlling the switch means 8. For example, the resistor 40 could be adjusted to provide an output pulse havig a duration of ten seconds which would thus cause the switch 8 to interrupt the program source 10 and connect the output 12 to the notification signal generator 6 for that length of time. Such a switch control signal is generated by the multivibrator 26 whenever the first operational amplifier 24 indicates that the variably set, predetermined level provided thereby has been exceeded. Thus, the multivibrator is a preferred embodiment of a means for causing the switch 8 to switch when the predetermined level has been exceeded. So, the sound level detector 4 includes a timing element which switches the switch 8 for a predetermined length of time between the notification signal generator 6 and the output member 12 when the received sound exceeds the predetermined level.

In addition to being transmitted to the sound level detector 4, the output from the sound receiver 2 is transmitted to the notification signal generator 6. In the FIG. 2 preferred embodiment it is shown that this output is connected to the signal generator 6 similarly to its connection to the sound level detector 4. That is, the notification signal generator 6 includes a second operational amplifier 42 which has an inverting input to which the sound receiver 2 output is connected through a fourth resistor 44. Likewise, the second operational amplifier 42 has a non-inverting input which is connected to the same second resistor 28/first resistor-capacitor 30 combination to which the first operational amplifier non-inverting input is connected. Furthermore, the second operational amplifier 42 includes a third variable resistor 45 connected between the inverting input and the output of the operational amplifier. Similar to the first operational amplifier 24, this third variable resistor 45 provides a second gain adjustment control for variably setting the magnitude of the electrical signals received from the sound receiver 2. However, instead of acting as an adjustable sensitivity set member, the operational amplifier 42 and its variable resistor 45 provide an amplification variation control element for varying the amplitude of the electrical signals representing the received sound pressure waves. That is, this preferred embodiment of the notification signal generator 6 provides volume control to the output member 12 during the time the member 12 is switched to the notification signal generator means 6. This is accomplished by connecting the output from the second operational amplifier 42 to the switch means 8 through a second transistor 46. In the FIG. 2 preferred embodiment the connection between the transistor 46 and the switch means 8 is made through a fifth resistor 48. In this way, when the switch means 8 is switched to provide a connection between the notification signal generator 6 and the output 12, the person is notified of the actual sound received and not simply of some non-descriptive alarm indication.

From the preceding description, it is apparent that the output from the sound level detector 4 is connected to a first input of the switch means 8 and that the output from the notification signal generator 6 is connected to a second input of the switch means 8. As shown in FIG. 2 the preferred embodiment of the switch means 8 is a relay 50. The first-input connection between the sound level detector 4 and the relay 50 is the connection between the output from the monostable multivibrator 26 and a capacitor-inductor network 52. The second-input connection between the notification signal generator 6 and the relay 50 is the connection between the resistor 48 and first switch contacts 54. In addition to these two input connections, FIG. 2 shows that the relay 50 includes second switch contacts 56 to which are connected the right and left channels of the hi-fi stereo equipment 58. This second set of switch contacts 56 provides the third input to the switch means 8. Also included in the relay 50 is a first output terminal 60 and a second output terminal 62. Each of these terminals is connected to a respective one of the channel inputs of a set of earphones 64 used as a preferred embodiment of the output member 12. Each of these terminals 60 and 62 is also connected to a respective one of two switch plates 66 and 68. Through this interconnection of elements and the operation hereinbelow described, the switch means 8 is controlled to connect either the program source 10 to the output member 12 or to connect the notification signal generator 6 output to the output member 12. That is, the output from the switch means 8 is switchable between the second input and the third input thereof.

In order to power the preferred embodiment electrical circuit shown in FIG. 2, a power supply, such as a battery, must be used. In FIG. 2 the power supply is represented by the power bus 70 and the ground bus 72.

It is to be noted at this point that the specific component values shown in FIG. 2 are not to be considered to be limiting in any way of the particular components that may be used to construct the present invention. These values are shown to indicate the present best mode to assist those having ordinary skill in the art to make the present invention.

Still with reference to FIG. 2, during the operation of the present invention sound pressure waves are received by the microphone 14 and converted into electrical signals which are transmitted to the transistor 16. The transistor 16 conditions the signals by providing a degree of amplification. The signals then go to the first and second operational amplifiers 24 and 42.

By adjusting the setting of the variable resistor 32 of the first operational amplifier 24, a predetermined amount of amplification can be provided to the electrical signals to thereby establish a predetermined level below which insufficient amplification for activating the monostable multivibrator 26 is provided. Thus, the first operational amplifier 24 is used to variably set the sensitivity level of the present invention. Once the predetermined level has been established and electrical signals of sufficient magnitude have been processed by the first operational amplifier 24, they are transmitted to the multivibrator 26. When the multivibrator 26 detects the reception of these signals, it generates control signals having durations of a predetermined length determined by the setting of the variable resistor 40. The multivibrator 26 provides these control signals to the first input of the relay 50.

Simultaneous with the processing of the electrical signals by the first operational amplifier 24 and the monostable multivibrator 26 is the processing of the initial electrical signals by the second operational amplifier 42. As with the first operational amplifier 24, the second operational amplifier 42 utilizes its variable resistor 45 to adjust the magnitude of the electrical signals. However, in this case the amplitude adjustment is to provide a volume control during that time when the switch means 8 is connected between the notification signal generator 6 and the output member 12. These amplitude adjusted signals are connected to the second input of the relay 50.

Prior to the reception of the control signals from the multivibrator 26, the relay 50 has its switch plates 66 and 68 in the position shown by the solid lines in FIG. 2. In this position these switch plates connect the channels from the stereo 58 to the output of the relay 50 and thus to the earphones 64. When a control signal from the multivibrator 26 is received, this signal activates the inductor coil in the capacitor-inductor combination 52 to switch the switch plates 66 and 68 from their contact with the second switch contacts 56 to the first switch contacts 54 as indicated by the dashed lines in FIG. 2. With the switch plates in this second position, the output of the relay, and thus also the earphones 64, is connected to the volume-controlled electrical signals from the notification signal generator 6. The switch plates 66 and 68 remain against the first switch contracts 54 only for the duration of the control signal from the multivibrator 26. Thus, the duration of the control signal can be adjusted to whatever duration is considered appropriate to enable the person wearing the earphones to hear the sound which is picked up by the microphone 14.

Figure 3A:
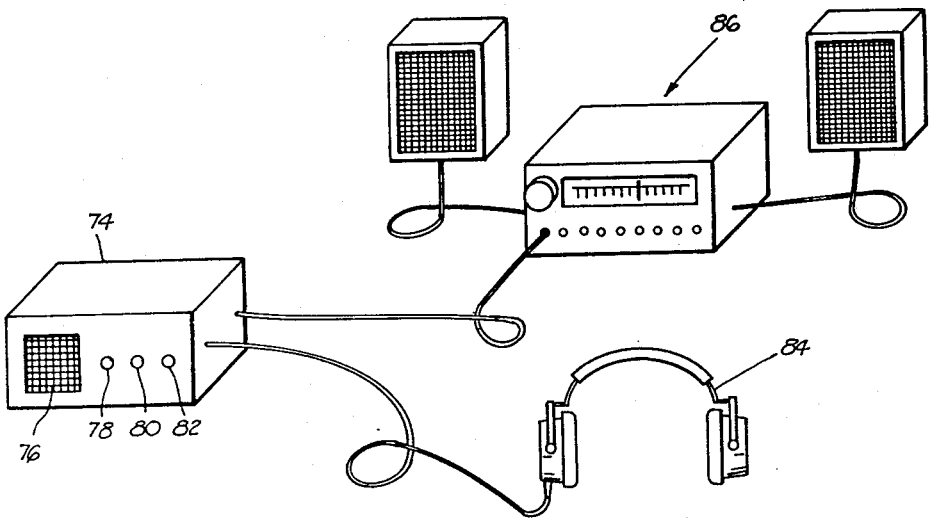
FIG. 3A is an illustration of one preferred external embodiment of the present invention.
Figure 3B:
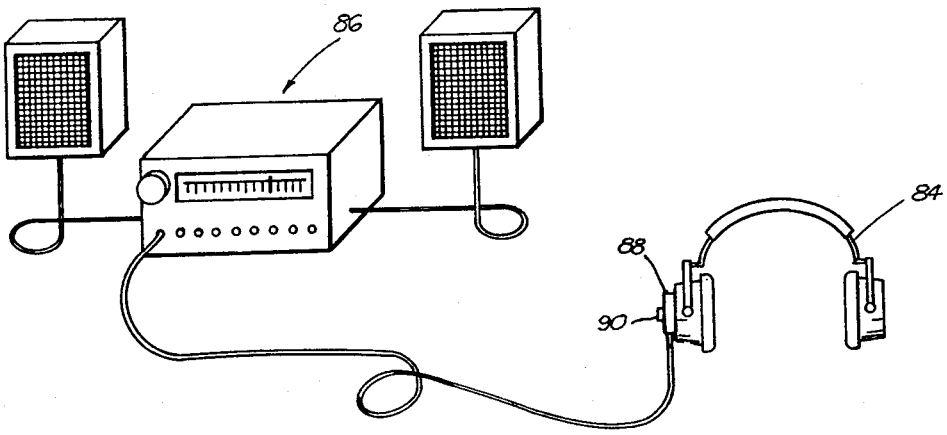
FIG. 3B is an illustration of a second preferred external embodiment of the present invention.

With reference now to FIGS. 3A and 3B, there is shown two different preferred embodiments of the external configuration of the present invention. In FIG. 3A the present invention is shown encased in an enclosure 74 which is suitable for placing on a table or other appropriate object. The enclosure 74 includes an opening 76 through which sounds may be propagated to the microphone 14. The enclosure also includes controls 78, 80 and 82 which are each connected to a respective one of the three variable resistors 32, 40 and 45 for variable adjustment thereof. The enclosure 74 also includes connectors for connecting the device to an output and to a program source, such as a set of earphones 84 and high-fidelity equipment 86 which provides the program to be heard by the user of the earphones 84.

In FIG. 3B the present invention is shown in a different configuration in that it is contained within a miniaturized enclosure 88 connected directly to the earphones 84. As with the larger enclosure 74, the smaller enclosure includes an opening for permitting the sound to travel to the microphone 14, a plurality of control elements 90 for variably adjusting the three variable resistors 32, 40 and 45, and connectors for communicating with the program source and the output.

Thus, the present invention of a sound detecting alarm device is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. An apparatus for notifying a person of the presence of a detected sound, comprising:

means for detecting sound;

a source of a program;

output means;

switch means, associated with said sound detecting means, said program source, and said output means, for switching said output means between electrical connection with said detecting means and electrical connection with said program source; and means, electrically connected to said sound detecting means and to said switch means, for controlling said switch means to electrically disconnect said output means from said program source and to electrically connect said output means to said sound detecting means when a sound having a magnitude in excess of a predetermined level is detected.

2. An apparatus as recited in claim 1, wherein said controlling means includes:

means connected to said sound detecting means for determining when said detected sound has a magnitude exceeding the predetermined level; and means connected to said determining means and to said switch means for causing said switch means to disconnect said output means from said program source and to connect said output means to said sound detecting means when the magnitude of said detected sound exceeds said predetermined level.

3. An apparatus as recited in claim 1, further comprising means, electrically connected between said sound detecting means and said switching means, for generating an output notification signal.

4. A program-interrupting, sound notification system comprising:

a sound receiver;

a switch means;

a notification signal generator, connected to said sound receiver and to said switch means, for generating electrical notification signals from sounds received by said sound receiver;

a program source means having an output providing electrical signals representing perceivable information connected to said switch means;

an audio output member connected to said switch means; and a sound level detector means, connected to said sound receiver and to said switch means, for controlling said switch means to disconnect said output member from the output of said program source and to connect said output member to said notification signal generator when a sound having a magnitude not less than a predetermined level is detected.

5. A notification apparatus as recited in claim 4, wherein said sound level detector includes:

a sensitivity set member for adjustably establishing a detection level for said received sounds below which no connection between said notification signal generator and said output member will occur; and means for providing a switching control signal to operate said switch means for a predetermined length of time to connect said notification signal generator to said output member when the magnitude of said received sound is not less than said detection level.

6. A notification apparatus as recited in claim 4, wherein said notification signal generator includes an amplitude variation control element for varying the amplitude of the electrical notification signals generated from said received sounds, said amplitude variation control element providing volume control to said audio output member when said output member is switched to said notification signal generator.

7. A notification apparatus as recited in claim 4, wherein said output member is a headphone.

8. An earphone alarm apparatus for notifying a person listening to an audio program of the existence of a sound external to said audio program but in the vicinity of said person, comprising:

sound transducer means for converting a received sound wave into an electrical signal;

sound level detector means, connected to said sound transducer means, for determining when said electrical signal exceeds a predetermined level and for providing a timing signal having a predetermined duration when said electrical signal exceeds said predetermined level;

notification signal generator means connected to said sound transducer means;

an audio program source;

switch means having a first input connected to said sound level detector means for receiving said timing signal therefrom, a second input connected to said notification signal generator means, a third input connected to said audio program source, and an output switchable between said second and third inputs, said output being switched to said second input when said timing signal is provided by said sound level detector means; and an earphone connected to said switch output.

9. An apparatus as recited in claim 5, wherein said sound level detector means includes an operational amplifier connected to said sound transducer means and having a gain adjustment control for variably setting said predetermined level.

10. An apparatus as recited in claim 9, wherein said sound level detector means further includes a monostable multivibrator connected to said operational amplifier and having an adjustable time constant means for variably setting said predetermined duration of said timing signal.

11. An apparatus as recited in claim 10, wherein said notification signal generator means includes a second operational amplifier connected to said sound transducer means and having a second gain adjustment control for variably setting the magnitude of the notification signal.

12. An apparatus as recited in claim 11, wherein said switch means is a relay.

13. An apparatus as recited in claim 12, wherein said sound transducer means includes:

a microphone; and a transistor line receiver.

14. An apparatus as recited in claim 13, wherein said audio program source includes high-fidelity stereo sound equipment.

15. An alarm apparatus for notifying a person listening to an audio program of the existence of a sound external to said audio program but in the vicinity of said person, comprising:

a microphone for converting received sound waves into electrical signals;

amplification means, connected to said microphone, for amplifying said electrical signals;

a first operational amplifier having an input connected to said amplification means and having a first gain adjustment control for variably setting a predetermined level which said electrical signals must exceed before said alarm apparatus notifies the person;

timer means, responsive to said first operational amplifier, for providing a timing signal;

a second operational amplifier having an input connected to said amplification means and having a second gain adjustment control for variably setting the magnitude of said electrical signals;

an audio program source;

an audio speaker; and a relay, responsive to said timer means, including:

switch plate means having an output terminal connected to said audio speaker, a first switch contact connected to said second operational amplifier, and a second switch contact connected to said audio program source; and an inductor means, connected to said timer means, for operating said switch plate means to connect the output terminal to the first switch contact when said timer means provides the timing signal and for operating said switch plate means to connect the output terminal to the second switch contact when no timing signal is provided.

* * * * *